US010322048B2

(12) United States Patent
Cooper et al.

(10) Patent No.: US 10,322,048 B2
(45) Date of Patent: Jun. 18, 2019

(54) SYSTEMS AND METHODS FOR POWERED WHEELCHAIR PERSONAL TRANSFER

(71) Applicant: Next Health, LLC, Rowayton, CT (US)

(72) Inventors: Rory Alan Cooper, Gibsonia, PA (US); David Beckstrom, Roxbury, CT (US); Raymond A. Curatolo, New Milford, CT (US); Garrett Grindle, Pittsburgh, PA (US); Richard Kovacsics, Hazleton, PA (US)

(73) Assignees: NextHealth, LLC, Rowayton, CT (US); University of Pittsburgh—of the Commonwealth System of Higher Education, Pittsburgh, PA (US)

( * ) Notice: Subject to any disclaimer, the term of this patent is extended or adjusted under 35 U.S.C. 154(b) by 0 days.

(21) Appl. No.: 15/883,908

(22) Filed: Jan. 30, 2018

(65) Prior Publication Data

US 2018/0214330 A1 Aug. 2, 2018

Related U.S. Application Data

(60) Provisional application No. 62/452,542, filed on Jan. 31, 2017.

(51) Int. Cl.
*A61G 7/16* (2006.01)
*A61G 7/10* (2006.01)
(Continued)

(52) U.S. Cl.
CPC ..... *A61G 7/165* (2016.11); *A61G 5/1056* (2013.01); *A61G 5/1067* (2013.01);
(Continued)

(58) Field of Classification Search
CPC .... A61G 7/165; A61G 7/1001; A61G 7/1059; A61G 7/1048; A61G 7/002;
(Continued)

(56) References Cited

U.S. PATENT DOCUMENTS 1,635,575 A 7/1927 Edwin
2,295,006 A 9/1942 Philips
(Continued)

FOREIGN PATENT DOCUMENTS

DE 102006011710 B3 8/2007
GB 2185883 A 8/1978

OTHER PUBLICATIONS

'An act relating to reducing injuries among patients and health care workers,' House Committee on Commerce and Labor. Available at: http://www.leg.wa.gov/pub/billinfo/2005-06/Pdf/Bill%20Reports/House/1672.HBR.pdf.

(Continued)

*Primary Examiner* — Robert G Santos
*Assistant Examiner* — David R Hare
(74) *Attorney, Agent, or Firm* — Proskauer Rose LLP

(57) ABSTRACT

The invention includes methods and apparatuses for patient transfer from a rollable chair to a bed and back. A rollable chair includes a first frame having a seat; a second frame coupled to the first frame, the second frame having a backrest configured to move relative to the first frame; and a third frame coupled to the first frame, the third frame having a track having a curvilinear length configured to allow the first frame to rotate and to translate relative to the third frame. A bed includes a chair-receiving frame configured to couple to the first frame of the rollable chair. The rollable chair and the bed work in tandem to transfer a patient, for example using coordinated, automated motions.

23 Claims, 14 Drawing Sheets

(51) Int. Cl.

| | |
|---|---|
| ***A61G 7/002*** | (2006.01) |
| ***A61G 5/10*** | (2006.01) |
| ***A61G 7/053*** | (2006.01) |
| *A61G 5/04* | (2013.01) |

(52) U.S. Cl.

CPC ..... *A61G 5/1075* (2013.01); *A61G 7/002* (2013.01); *A61G 7/053* (2013.01); *A61G 7/1001* (2013.01); *A61G 7/1032* (2013.01); *A61G 7/1034* (2013.01); *A61G 7/1048* (2013.01); *A61G 7/1059* (2013.01); *A61G 7/1069* (2013.01); *A61G 5/04* (2013.01); *A61G 7/1065* (2013.01); *A61G 2203/30* (2013.01); *A61G 2203/80* (2013.01)

(58) Field of Classification Search

CPC .. A61G 7/1069; A61G 7/1034; A61G 7/1073; A61G 2203/30; A61G 5/00; A61G 5/04; A61G 5/0866; A61G 5/10; A61G 5/1067; A61G 5/1075; A61G 5/1056; A61G 7/053; A61G 7/1032; A61G 7/1065; A61G 2203/80

USPC ..... 297/313, 316, 317, 318, 322, 325, 327, 297/329, 344.24

See application file for complete search history.

(56) References Cited

U.S. PATENT DOCUMENTS 4,025,088 A * 5/1977 Rothschild ..... A61G 5/08 280/42
4,100,415 A 7/1978 Blaisdell et al.
4,240,169 A 12/1980 Roos
4,654,903 A 4/1987 Chubb et al.
4,679,259 A 7/1987 Dimatteo et al.
4,718,133 A 1/1988 Dimatteo et al.
4,726,082 A 2/1988 Dimatteo et al.
4,776,047 A 10/1988 Dimatteo et al.
4,787,104 A 11/1988 Grantham
4,787,107 A 11/1988 Dimatteo et al.
4,796,313 A 1/1989 Dimatteo et al.
4,797,960 A * 1/1989 Vaiana ..... A61G 5/00 297/337
4,813,088 A * 3/1989 DiMatteo ..... A61G 5/104 5/81.1 C
4,819,283 A * 4/1989 DiMatteo ..... A61G 5/00 5/81.1 C
4,821,352 A 4/1989 Dimatteo et al.
4,834,449 A * 5/1989 Engelman ..... A47B 3/14 108/134
4,837,872 A * 6/1989 DiMatteo ..... A61G 7/053 5/713
4,837,873 A 6/1989 Dimatteo et al.
4,941,200 A 7/1990 Leslie et al.
4,957,302 A * 9/1990 Maxwell ..... A47C 3/0257 280/32.6
5,020,171 A 6/1991 Dimatteo et al.
5,050,899 A * 9/1991 Stensby ..... A61G 5/006 280/250.1
5,103,512 A 4/1992 Dimatteo et al.
5,127,113 A * 7/1992 Di Matteo ..... A61G 7/005 5/612
5,319,813 A 6/1994 Dimatteo et al.
5,469,588 A 11/1995 Dimatteo et al.
5,526,543 A 6/1996 Dimatteo
5,535,459 A * 7/1996 DiMatteo ..... A61G 7/001 297/DIG. 10
5,596,775 A * 1/1997 DiMatteo ..... A61G 7/001 297/335
5,634,688 A 6/1997 Ellis
5,729,842 A * 3/1998 McCarthy ..... A61G 5/00 5/83.1
5,799,347 A 9/1998 Mccarthy
6,203,106 B1 * 3/2001 Nearing ..... A61G 5/107 297/284.9
6,409,265 B1 * 6/2002 Koerlin ..... A61G 5/006 297/325
6,846,042 B2 1/2005 Hanson et al.
7,340,784 B2 3/2008 Stryker et al.
7,481,494 B2 * 1/2009 Sagstuen ..... A61G 5/00 297/300.4
7,568,240 B2 8/2009 Palay et al.
7,712,165 B2 5/2010 Guguin
7,735,165 B2 6/2010 Stryker et al.
7,752,687 B1 7/2010 Denosky
7,774,873 B2 8/2010 Martin et al.
7,841,611 B2 11/2010 Ivanchenko
8,297,641 B2 10/2012 Landry et al.
8,419,130 B2 * 4/2013 Bergman ..... A61G 5/042 180/907
8,690,178 B2 * 4/2014 Griswold ..... A61G 5/10 280/250.1
9,010,787 B2 * 4/2015 Slagerman ..... A61G 5/1075 280/250.1
9,333,131 B2 5/2016 Griswold et al.
9,554,955 B2 * 1/2017 Blauch ..... A61G 5/1075
2003/0001585 A1 1/2003 Montrose
2005/0242634 A1 * 11/2005 Serber ..... B60N 2/0745 297/216.1
2010/0126793 A1 5/2010 Flowers et al.
2011/0030138 A1 2/2011 Kawakami et al.
2011/0258771 A1 * 10/2011 Hammer ..... A61G 5/1002 4/667
2012/0153687 A1 * 6/2012 Kume ..... A61G 5/1067 297/118
2012/0169093 A1 * 7/2012 Kume ..... A61G 5/04 297/118
2015/0272797 A1 * 10/2015 Hines ..... A61G 5/14 297/75

OTHER PUBLICATIONS

Arnold, Roe E., Williams D., "A pictorial overview of technology-assisted care options for bariatric patients: one hospital's experience," *Ostomy Wound Manage*, 2014, 60(1):36-42.

Bell, J., Collins, et al., 'Preventing Back Injuries in Health Care Settings. NIOSH Science Blog, Centers for Disease Control and Prevention,' 2008, available from http://blogs.cdc.gov/niosh-science-blog/2008/09/22/lifting/.

Charney, W., Hudson A. 2004. Back injury among healthcare workers: causes, solutions, and impacts. CRC Press LLC, pp. 123-138.

Cohen, M.H. et al. "Patient handling and movement assessments: a white paper," The Facility Guidelines Institute, Apr. 2010.

Crytzer, T.M. et al., "Identifying research needs for wheelchair transfers in the built environment" *Disability and Rehabilitation: Assistive Technology*, 2015, DOI: 10.3109/17483107.2015.1042079.

Engst, C., et al., "Preventing back injuries to healthcare workers in British Columbia, Canada and the ceiling lift experience," in Back Injury among Healthcare Workers: Causes, Solutions, and Impacts, 2004, eds. W. Charney & A. Hudson, Boca Raton, FL: Lewis Publishers, 253-63.

Grindle, G.G. et al., "Design and User Evaluation of a Wheelchair Mounted Robotic Assisted Transfer Device," *BioMed. Res. Intl.*, 2014, 9 pages, Article ID 198476.

Hart, S.G., "NASA-Task Load Index (NASA-TLX): 20 years later," 2006, Paper presented at the HFES; San Francisco, CA.

Jagar, M., et al., "Lumbar-load analysis of manual patient-handling activities for biomechanical overload prevention among healthcare workers," *Ann. Occup. Hyg.*, 2013, 57(4): 528-544.

Lloyd, J.D., et al, "Friction-reducing devices for lateral patient transfers," *OHN Journal*, 2006; 54(3):113-9.

Lloyd, John, "Biodynamics of Back Injury: Manual Lifting and Loads," Jan. 2003, 32 pages.

(56) References Cited

OTHER PUBLICATIONS

Marras W.S., et al., "A comprehensive analysis of low back disorder risk and spinal loading during the transferring and repositioning of patients using different techniques," *Ergonomics*, 1999, 42 (7), 904-926.

Nelson A, Lloyd JD, Menzel N, Gross C. Preventing nursing back injuries: designing patient handling tasks. AAOHN Journal 2003;51(3):126-34.

Noble, Nancy L., et al., "Barrier to the Use of Assistive Devices in Patient Handling," Workplace Health & Safety, Jan. 2018, vol. 66, No. 1 pp. 41-48.

Owen, B., & Garg, A. (1990). Assistive devices for use with patient handling tasks. In Das, B. (Ed). Advances in Industrial Ergonomics and Safety. Philadelphia, PA: Taylor & Frances.

Patient Safety Center of Inquiry (Tampa, FL) (2005) Patient Care Ergonomics Resource Guide: Safe Patient Handling and Movement. Veterans Health Administration and Department of Defense. Available from http://www.visn8.va.gov/visn8/patientsafetycenter/resguide/ErgoGuidePtOne.pdf.

Randall SB, Porie WJ, Pearson A, Drake DJ. Expanded Occupational Safety and Health Administration 300 log as metric for bariatric patient-handling staff injuries. Surg Obes Related Disease. 2009;5(4): 463-468.

Snook SH, Ciriello VM. The design of manual handling tasks: revised tables of maximum acceptable weights and forces. Ergonomics. 1991;34(9): 1197-1213.

U.S. Department of Labor, Occupational Safety and Health Administration. (2002). Ergonomics guidelines for nursing homes. Retrieved Jun. 22, 2003 from the world wide web at: www.osha.gov/ergonomics/guidelines/nursing home/final_nh_guidelines.html.

Wilson, Tiffany Poole, et al., "Quantification of Patient and Equipment Handling for Nurses through Direct Observation and Subjective Perceptions," Advances in Nursing, vol. 2015, Article ID 928538, 7 pages.

Yoji A (1994) Development History of Quality Function Deployment. The Customer Driven Approach to Quality Planning and Deployment. Minato, Tokyo 107 Japan: Asian Productivity Organization. p. 339.

* cited by examiner

SYSTEMS AND METHODS FOR POWERED WHEELCHAIR PERSONAL TRANSFER

RELATED APPLICATIONS

This application claims the benefit of U.S. Provisional Patent Application Ser. No. 62/452,542 filed Jan. 31, 2017, entitled "Systems and Methods for Powered Wheelchair Personal Transfer," the contents of which are hereby incorporated herein by reference in their entirety.

GOVERNMENT RIGHTS

This invention was made with government support under Contract Nos. B9269-L and B9250C, awarded by the U.S. Dept. of Veterans Affairs, and Contract No. EEC-1560174S, awarded by the National Science Foundation. The U.S. Government may have certain rights in the invention.

FIELD OF THE INVENTION

The invention relates generally to devices, apparatuses, systems and methods for patient transfer. More specifically, the invention relates to patient transfer from a rollable powered wheelchair to a bed and back.

BACKGROUND

Transferring a person with a disability (PwD) between a bed and a wheelchair—or standing position, commode, chair, walker, and/or toilet—can be a labor intensive and time consuming task. In some cases, it can take multiple people to perform the transfer and can cause injury (both acute and cumulative) to the PwD, the caregiver, and/or the transfer equipment, particularly if errors are made during transfer (e.g., if the chair is mis-positioned or the brakes are not engaged). Other risks of PwD transfer include fear, loss of dignity, and increased dependence on others.

For PwDs who need assistance with transfers, there are not a lot of good options. The most commonly used lift technologies include the overhead ceiling lift, the floor-based sling lift, and the Gantry lift. While these devices allow for safer transfer of PwDs, they do so with shortcomings. For example, overhead sling lifts require extensive installation that may not be suitable for homes or buildings with structural deficiencies or low ceilings; floor-based sling lifts have issues with caregiver manipulation and ease of use; and gantry lifts are difficult to move and store due to their size.

Research and experience suggest that caregivers and PwDs are unsatisfied with current patient transfer technology, and are concerned that their lifestyle is impaired by the lack of appropriate technologies or that it will negatively affect them and their caregivers in their futures. Typically, wheelchairs and beds have been regarded as separate technologies, with the designers of one technology not working in tandem with designers of the other to coordinate movement between the two. What is needed is a solution that makes patient transfer more streamlined, convenient, and safe, both for the patient and the caregivers involved.

SUMMARY OF THE INVENTION

The present invention includes improved systems and methods for patient transfer, such as enabling autonomous transfers of an occupant of a rollable chair (e.g., a powered wheel chair or "PWC") to and from a bed. In some embodiments, the invention includes a powered, pedestal-mount wheelchair that works in tandem with a hospital bed having a built-in conveyor. In some embodiments, the invention provides powered, coordinated and synchronized motion of the wheelchair seat and the bed to allow for independent transfers from one to the other while minimizing the physical effort needed by the patient and/or the caregiver(s) during transfer. In some embodiments, the invention includes a new transfer device for users of electric powered wheelchairs ("EPWs") that is designed to reduce environmental and equipment complications that can lead to progressive inactivity of persons with disabilities, as well as frustration and injury risks experienced by users and their assistants. In some embodiments, the invention automates EPW-to-bed transfers, saving time, minimizing staff involvement, and decreasing caregiver risk.

In some embodiments, the seat frame of the chair travels rearward and rotates to move the seated occupant onto or proximal to the foot end of the bed. For context, in certain prior manual chair configurations, these motions have been handled with separate frames (a sliding frame and a rotating seat frame) and were separately powered by actuators in a docking module of the bed. In the present invention, these motions can be produced by a single seat frame powered by just one actuator. For example, the seat frame can be drawn along a "J"-shaped path or track. In some embodiments, the actuator initially draws a rearward edge of the seat frame horizontally along a straight section of the track. This movement begins to position the occupant proximal to the moving bed conveyor by closing the gap between the seat frame and the bed. Once in position for transfer, the powered wheelchair backrest rotates or translates laterally and the PwD leans against the mattress of the bed, which has been positioned near vertically. The actuator continues to draw the rear edge of the seat frame down along the arced path, causing the front edge of the seat frame to tip upward toward the bed, further pushing and/or lifting the occupant's legs up onto the moving bed conveyor. The bed rotates synchronously as the conveyor moves to minimize shear by matching the kinematics and rate of motion.

In some embodiments, the chair has a leg ramp with a foot rest that is hinged at the front edge of the seat frame, and linkage connecting the leg ramp to the seat frame can control the angle between the two. In some embodiments, the nominal angle is potentially adjustable to allow an elevated position to support the occupant's legs while the chair is in the "normal" position. The linkage can control and synchronize the angle of the ramp/leg rest to minimize shear forces on the occupant's legs during transfers and when the chair is in the "tilt" position. The linkage can also control leg ramp position without the need for another actuator.

In some embodiments, a powered back helps to enable autonomous or independent transfers. The powered back can be configurable, for example, to rotate or slide to the left or right and can be field-adjustable. The system can control the point in the transfer when the back unlocks and pivots out from behind the chair occupant. Sensors can ensure correct back position and locking. Motor current may be monitored to detect collisions of the back into objects or to cause a prompt to the occupant to lean forward off the chair back. An armrest opposite the side of the back that pivots can be moved out of the way by the occupant. In some embodiments, sensing of this position and powered locking may be used.

In some embodiments, actuators and mechanisms for seat and back frames occupy space to the rear and sides of the chair, leaving the volume directly under the seat relatively open. This arrangement can provide a single, centered mounting point that fits to a post of the PWC. In some embodiments, this design can be adapted to pedestal-mount chairs from several manufacturers. In some embodiments, the design can be revised to work with wheelchairs with base designs other than the pedestal-mount designs. In some embodiments, as the chair translates for transfer the seat frame tilts backward. This feature can provide a powered tilt option. In this mode the chair back can be left locked in place and rearward translation can provide an adjustable amount of tilt. In some embodiments, movement of the chair back can be limited, e.g., to prevent a center of gravity from moving to an unstable point or tipping point.

In some embodiments, the chair connects to and communicates with the bed electronically, e.g., by umbilical cable or wirelessly. The actuators in the chair may be powered directly from the bed if connected by umbilical or from the chair's own controller or power supply. Whether powered from the bed or self-powered, command of chair movements and/or actuators can be controlled and coordinated by a controller (located, e.g., in the bed, or anywhere within wireless communication range if connected wirelessly). In some embodiments, the motions of both can be synchronized for safe and comfortable transfers. In some embodiments, both the chair and the bed can have absolute sensing of actuators positions, speed and current draw, and separate IO to ensure correct frame positions and frame locking. In some embodiments, chair and bed use actions are logged by the bed and stored electronically.

In some embodiments, the chair is positioned at the foot of the bed (and/or couples to the bed, e.g., mechanically and/or electronically) for transfer. One approach is to use a docking assembly or docking platform. In such embodiments, an operator can drive the chair up onto the docking platform from almost any angle within a ground plane. In some embodiments, the docking assembly can sense the approach angle of the chair and rotate or otherwise move to align with it. Once the chair is properly positioned on the platform, the docking assembly can rotate the chair to be square to the foot end of the bed and draw a platform back for transfer. Command of the docking assembly can reside, e.g., in the bed controller. In some embodiments, the chair positions itself using a drive system. In some embodiments, the docking assembly includes electronic docking options based on user ability.

In some embodiments, the rollable chair is an EPW and/or a Group-2 wheelchair. In some embodiments, the patient transfer system allows a patient to transfer from the chair to the bed and back with minimal or no assistance from a caregiver. In some embodiments, the movements of the bed and custom wheelchair seating system are electrically powered and synchronized through computer control. In some embodiments, the patient transfer system is particularly suitable for patients with a primary diagnosis of obesity, cardiovascular disease, cardiopulmonary disease, paraplegia with upper extremity pain or overuse injury, or metabolic diseases, at least because they often use powered wheelchairs and have the ability to operate their powered wheelchair and to control the interface for the transfer device.

In one aspect, the invention features a rollable chair. The rollable chair includes a first frame including a seat. The rollable chair also includes a second frame coupled to the first frame, the second frame including a backrest configured to move relative to the first frame. The rollable chair also includes a third frame coupled to the first frame, the third frame including a track having a curvilinear length configured to allow the first frame to rotate and/or to translate relative to the third frame.

In some embodiments, the track further includes a linear length configured to allow the first frame to translate relative to the third frame, the linear length adjoining the curvilinear length. In some embodiments, the track includes a J-shape. In some embodiments, the first frame is powered by a first actuator that is mechanically coupled to the first frame. In some embodiments, the rollable chair includes at least one sensor, connected to the rollable chair, for determining a position of the rollable chair relative to a bed. In some embodiments, the second frame is configured to rotate about a pivot point to permit the backrest to be removed from a path of patient transfer between the rollable chair and a bed. In some embodiments, the second frame is powered by a second actuator that is mechanically coupled to the second frame.

In some embodiments, the second frame includes a latching mechanism configured to engage with a corresponding latching mechanism of the third frame. In some embodiments, the corresponding latching mechanism on the third frame includes a taper configured to proper alignment of the rollable chair. In some embodiments, the rollable chair includes a quick-release feature for aiding an assistant with disengaging the rollable chair from a bed. In some embodiments, the rollable chair further includes a fourth frame that is mechanically coupled to the first frame, the fourth frame including a leg rest. In some embodiments, the first and fourth frames are rigidly coupled, the fourth frame configured to guide a patient's legs during a patient transfer operation. In some embodiments, the rollable chair is configured to couple to a bed having a chair receiving frame. In some embodiments, the seat has a posterior tilt with respect to the rollable chair.

In another aspect, the invention includes a patient transfer system. The patient transfer system includes a rollable chair having a first frame including a seat; a second frame coupled to the first frame, the second frame including a backrest configured to move relative to the first frame; and a third frame coupled to the first frame, the third frame including a track having a curvilinear length configured to allow the first frame to rotate and/or to translate relative to the third frame. The patient transfer system also includes a bed including a chair receiving frame configured to couple to the first frame of the rollable chair.

In some embodiments, the patient transfer system further includes a first microprocessor coupled to the rollable chair and a second microprocessor coupled to the bed, the first microprocessor in direct or indirect electronic communication with the second microprocessor. In some embodiments, the patient transfer system further includes a computing device in electronic communication with the first and second microprocessors, the computing device configured to execute instructions to coordinate kinematics between the rollable chair and the bed during a patient transfer operation. In some embodiments, a motion path of the seat is determined by the computing device and includes both translational and rotational components.

In some embodiments, the bed is configured to fold during a patient transfer operation between the rollable chair and the bed, the bed configured to work in tandem with the rollable chair to receive the patient during a patient transfer operation. In some embodiments, the patient transfer system further includes a docking assembly configured to receive the rollable chair and to facilitate transfer of a patient from the rollable chair to the bed. In some embodiments, the docking assembly is configured to receive the rollable chair from any (or nearly any) angle of approach within a ground plane. In some embodiments, the docking assembly includes a third microprocessor, the third microprocessor in direct or indirect electronic communication with the first and second microprocessors. In some embodiments, the bed includes a sensor configured to ensure that the rollable chair is properly positioned with respect to the bed. In some embodiments, the rollable chair is a retrofitted Group 2 Electric Powered Wheelchair.

In another aspect, the invention features a method of transferring a patient between a rollable chair and a bed. The method includes positioning the rollable chair at or near a proximal end of the bed. The method also includes translating a distal end of the bed toward the proximal end of the bed, the bed folding into a first section and a second section, wherein the first section becomes positioned behind a chair back of the rollable chair and the second section forms an angle with the first section. The method also includes moving the chair back of the rollable chair, via at least one of a rotational or a translational motion, such that the patient contacts the first section of the bed. The method also includes moving a seat frame of the rollable chair along a guide rail disposed relative to the seat frame, via at least one of a translational or a rotational motion, to position the patient at least substantially on the bed.

In some embodiments, the guide rail is a track having a curvilinear length. In some embodiments, moving the chair back is accomplished using a powered actuator. In some embodiments, moving the seat frame is coordinated with a simultaneous or near-simultaneous moving of the bed. In some embodiments, positioning the rollable chair at or near a proximal end of the bed is achieved using a docking assembly positioned proximate the bed and the rollable chair.

BRIEF DESCRIPTIONS OF THE DRAWINGS

DETAILED DESCRIPTION

Figure 1A:
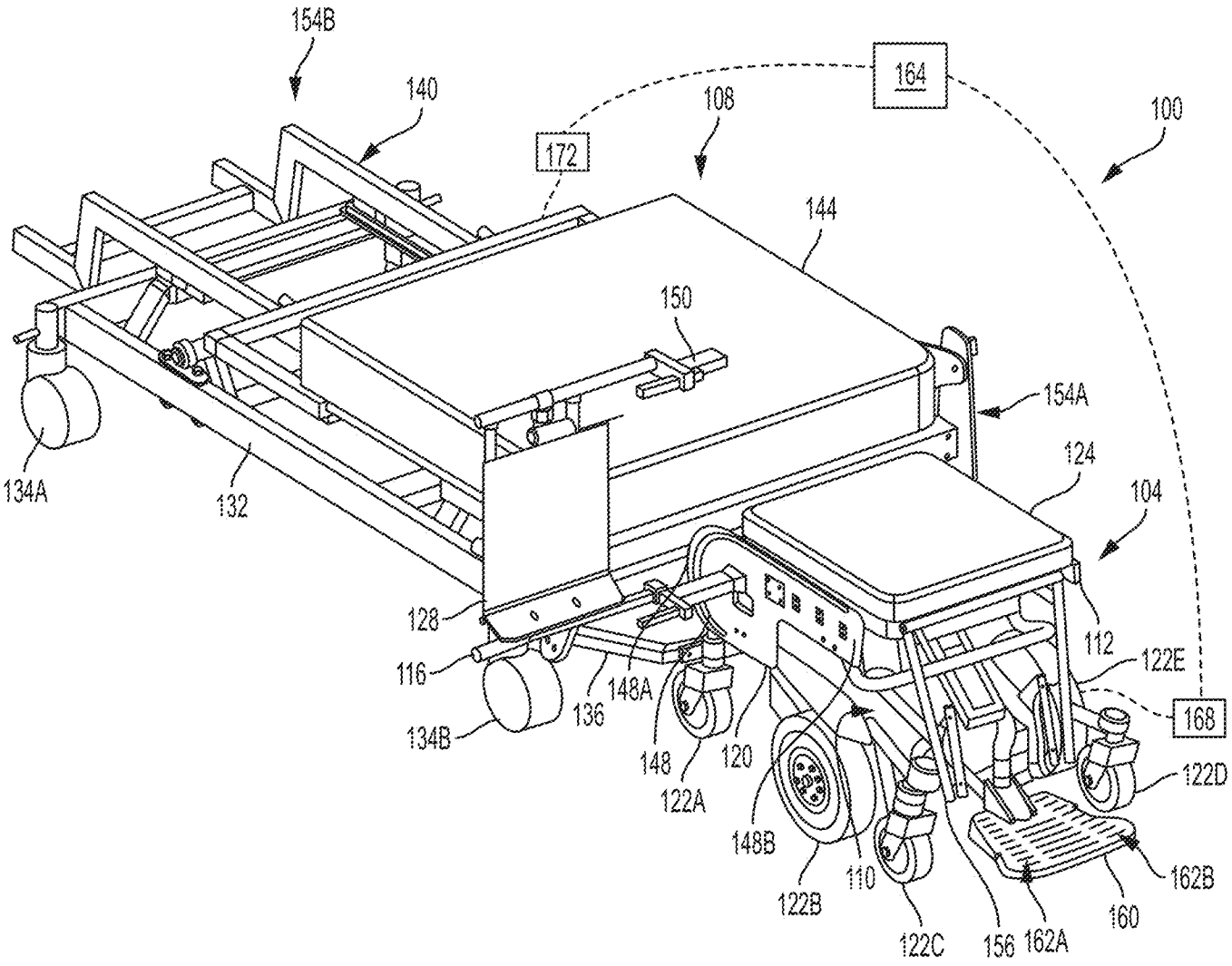
FIG. 1A is an isometric view of a patient transfer system including a rollable chair and a bed, according to an illustrative embodiment of the invention.
Figure 1B:
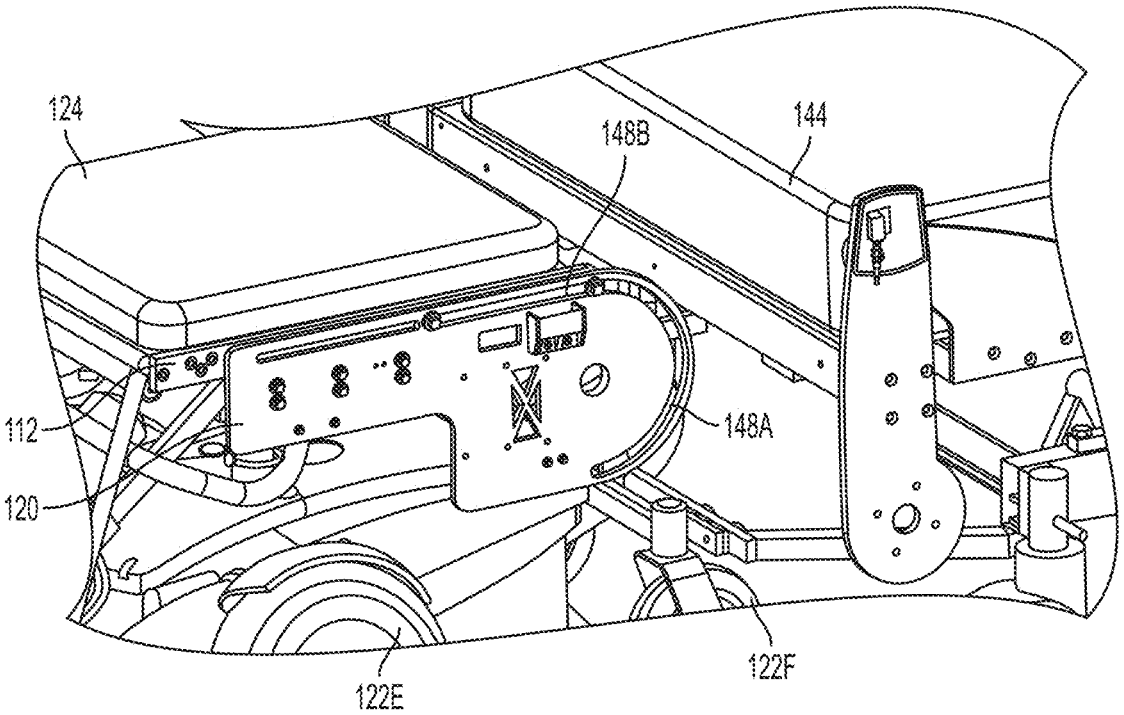
FIG. 1B is a side view of the patient transfer system of FIG. 1A showing a seat and a frame having a "J" shape track, according to an illustrative embodiment of the invention.
Figure 1C:
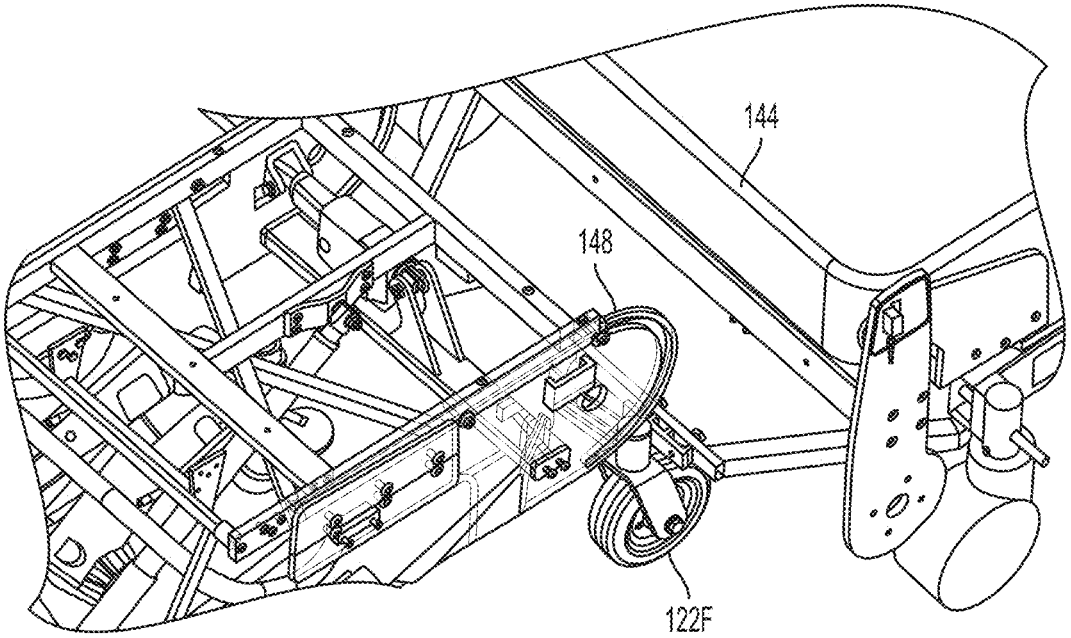
FIG. 1C is a side view of the patient transfer system of FIG. 1A with the seat removed, according to an illustrative embodiment of the invention.

FIG. 1A is an isometric view of a patient transfer system 100 including a rollable chair 104 (also depicted separately in FIG. 1F) and a bed 108, according to an illustrative embodiment of the invention. The rollable chair 104 includes a first frame 112, a second frame 116 coupled to the first frame 112, and a third frame 120 coupled to the first frame 112. The frames 112, 116, 120 can be made of, for example, steel, aluminum, another metal or metal alloy, or a composite material such as carbon fiber. The rollable chair 104 also includes several wheels (e.g., wheels 122A-F as shown in FIGS. 1A-1E). The base unit 110 can be a commercially available pedestal seat powered wheelchair base. In some embodiments, the wheels 122A, 122F (rear wheels) help to guide the rollable chair 104 toward the bed 108. In some embodiments, the wheels 122B, 122E (drive wheels) are larger and help to power the rollable chair 104. In some embodiments, the wheels 122C and 122D (front wheels) help to guide the rollable chair 104 with forward motion.

The first frame 112 includes a seat 124, which can be a square cushion capable of supporting a patient. The seat 124 can assume a posterior tilt with respect to the rollable chair 104 during a patient transfer operation, as shown and described in greater detail below. The second frame 116 includes a backrest 128, which can include a section of canvas, cloth, or another material capable of supporting a patient's back and/or matching the size and medical needs of the user. The backrest 128 can be configured to move relative to the first frame 112, e.g., to rotate about a pivot point or to translate, such that the backrest 128 is removable from a patient transfer path between the rollable chair 104 and the bed 108 during a patient transfer operation. For example, in FIG. 1A, the second frame 116, and correspondingly the backrest 128, are shown rotated 90 degrees from the upright position, such that the backrest is fully removed from the patient's path from the seat 124 to the bed 108.

The third frame 120 includes a track 148 (e.g., having a curvilinear length 148A) configured to allow the first frame 112 to rotate and to translate relative to the third frame 120, for example, during a patient transfer operation as shown and described in greater detail below. In some embodiments (e.g., as shown in FIG. 1A), the track 148 also includes a linear length 148B configured to allow the first frame to translate relative to the third frame. In some embodiments, the linear length 148B adjoins the curvilinear length 148A. In some embodiments, the two lengths 148A, 148B collectively form a "J-shape". In some embodiments, the first frame 112 is powered by a first actuator (e.g., the actuator 190 as shown in FIG. 1G) that is mechanically coupled to the first frame 112. In some embodiments, the second frame 116 is powered by a second actuator (e.g., the actuator 192 as shown in FIG. 1H) that is mechanically coupled to the second frame 116. In some embodiments, the rollable chair 104 includes a latching mechanism 152 that is configured to engage with a corresponding latching mechanism of the first frame 112, e.g., such that when the latching mechanism 152 is engaged with the corresponding latching mechanism, the first frame 112 is secured to the second frame 116 (e.g., as shown and described in FIGS. 2A and 2B).

The bed 108 includes a first frame 132 (e.g., a main frame), a second frame 136 (e.g., a chair receiving frame), and a third frame 140 (e.g., a movable frame). The first frame 132 includes wheels (e.g., wheels 134A, 134B). The second frame 136 interfaces with sensors of the rollable chair 104 (as shown and described below). The third frame 140 includes a mattress 144 and can be powered by a bed actuator. The bed 108 (e.g., the mattress 144) is configured to fold during a patient transfer operation between the rollable chair 104 and the bed 108, the bed 108 configured to work in tandem with the rollable chair 104 to receive the patient during a patient transfer operation. The bed has a proximal end 154A (e.g., a foot end) and a distal end 154B (e.g., a head end), the distal end 154B configured to translate toward the proximal end 154A during a patient transfer operation.

In some embodiments, the rollable chair 104 includes a fourth frame 156 that is mechanically coupled to the first frame 112. In some embodiments, the fourth frame 156 includes a leg rest 160 (e.g., is rigidly coupled to the leg rest 160). In some embodiments, the leg rest 160 includes two separate shoe prints 162A, 162B for separately accommodating a patient's two feet. In some embodiments, the leg rest 160 is made of molded plastic or another lightweight material suitable for supporting a patient's feet. In some embodiments, the fourth frame 156 is configured to guide a patient's legs during a patient transfer operation (e.g., as shown and described below in FIG. 4). In some embodiments, the leg rest 160 uses a cam follower driven with the seat actuator.

In some embodiments, the patient transfer system 100 includes a computing device 164 configured to execute instructions to coordinate movements between the rollable chair 104 and the bed 108 during a patient transfer operation. The computing device 164 can be in direct or indirect electronic communication with a first microprocessor 168 coupled to the rollable chair 104, and/or a second microprocessor 172 is coupled to the bed 108. In some embodiments, the computing device 164 is included the bed 108. In some embodiments, electronic communication is hard-wired and/or wireless. In some embodiments, the computing device 164 sends instructions to microprocessors 168, 172, which in turn trigger movements of first and second actuators and determine a motion path of the first frame 112 relative to the bed 108 (as shown and described in greater detail below). In some embodiments, a master/slave approach is used for the computing operations (e.g., as shown and described below in FIG. 6), where the master is equivalent to the computing device 164. In some embodiments, the master can be anywhere within hard-wired or wireless electronic communication distance, as applicable.

Figure 1D:
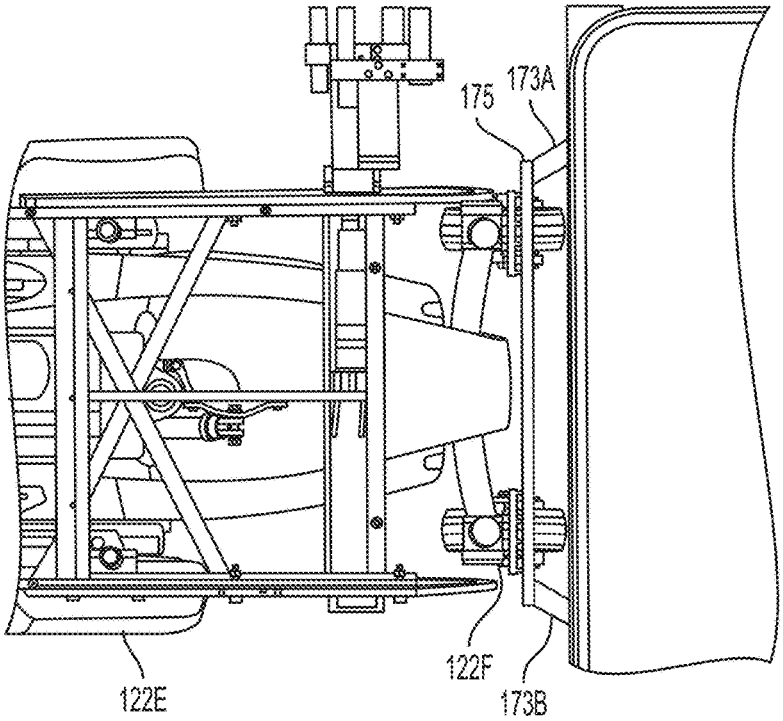
FIG. 1D is a top view of the patient transfer system of FIG. 1A showing a rollable chair interacting with dock sensors, according to an illustrative embodiment of the invention.
Figure 1E:
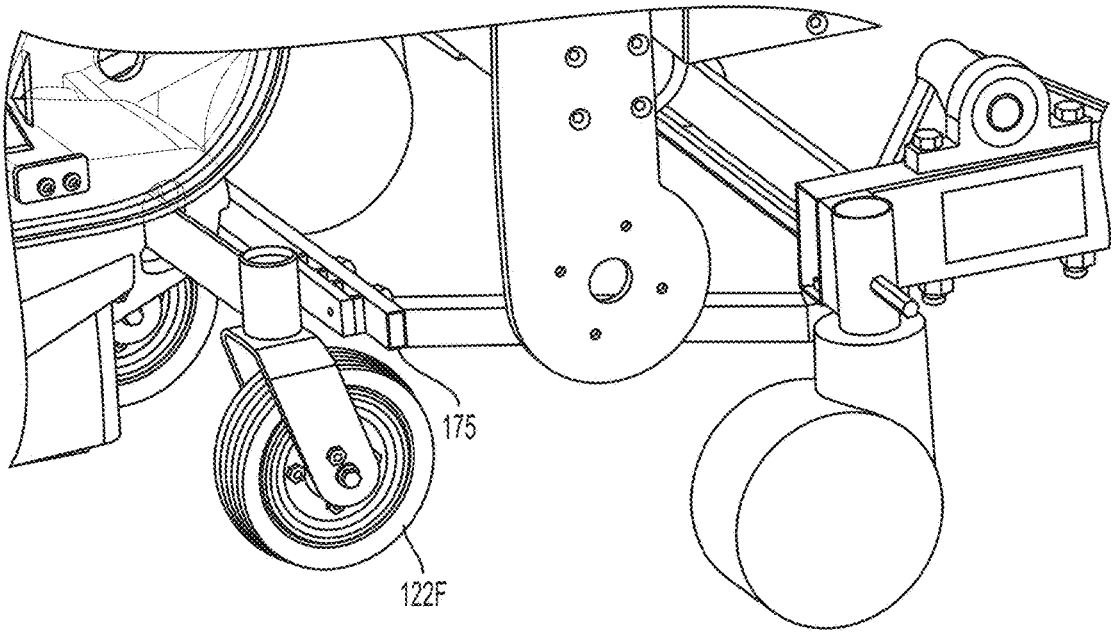
FIG. 1E is a side view of the patient transfer system of FIG. 1A showing a rollable chair interacting with dock sensors, according to an illustrative embodiment of the invention.
Figure 1F:
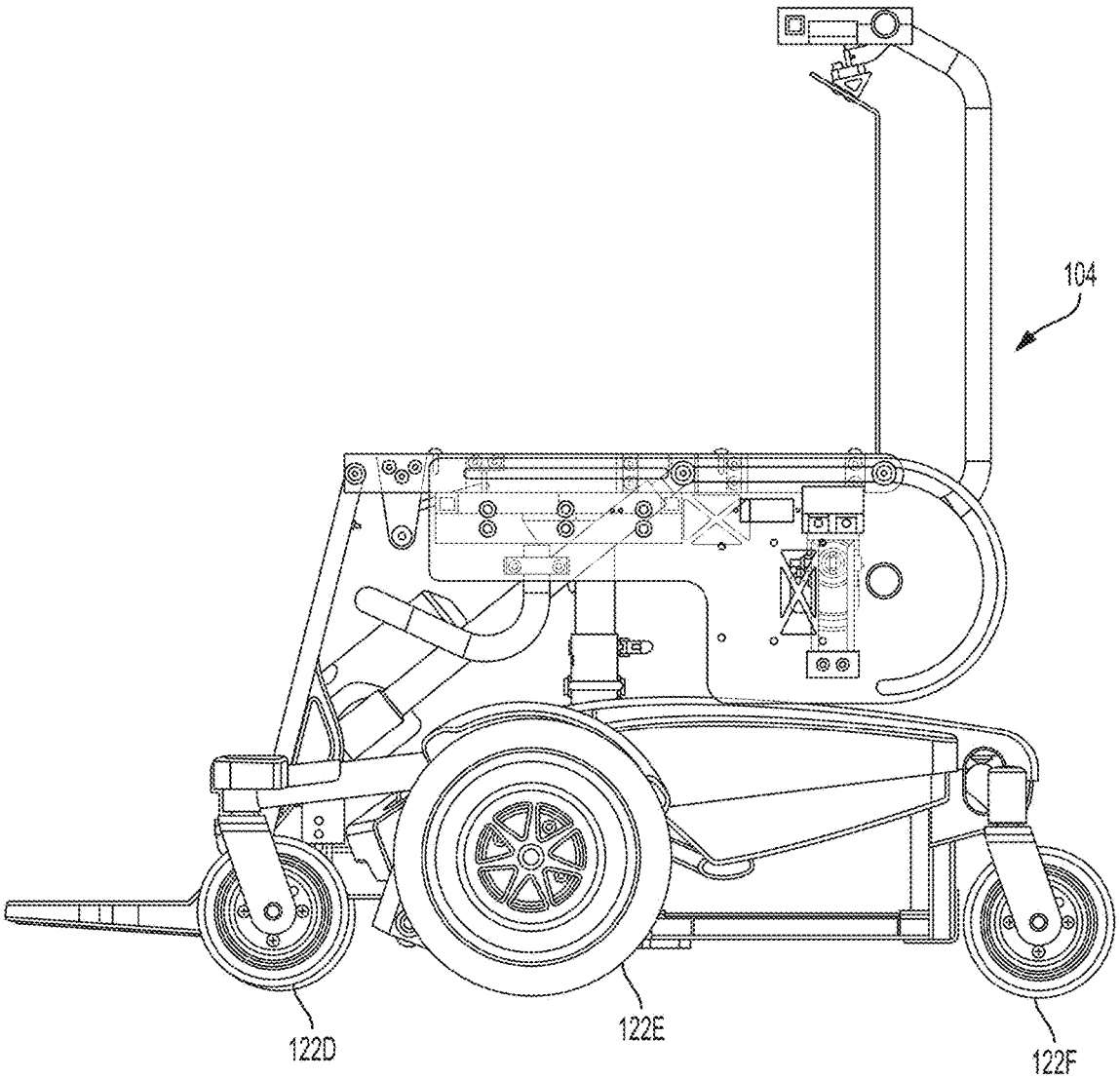
FIG. 1F is a side view a rollable chair, according to an illustrative embodiment of the invention.
Figure 1G:
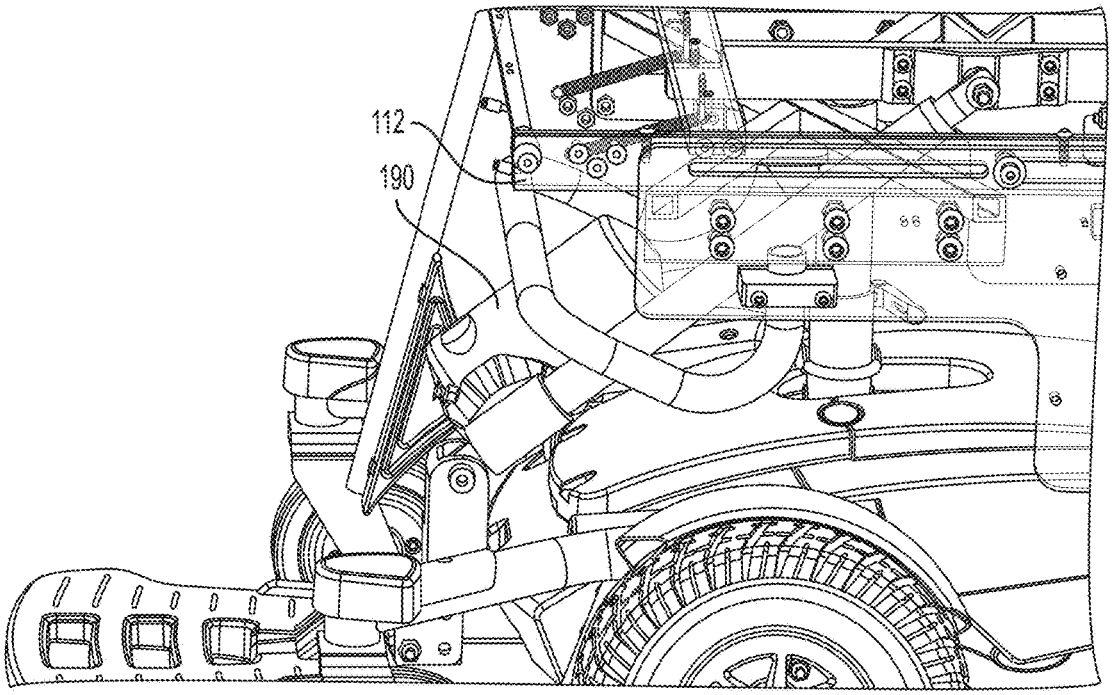
FIG. 1G is a close-up view of a seat actuator of a rollable chair, according to an illustrative embodiment of the invention.
Figure 1H:
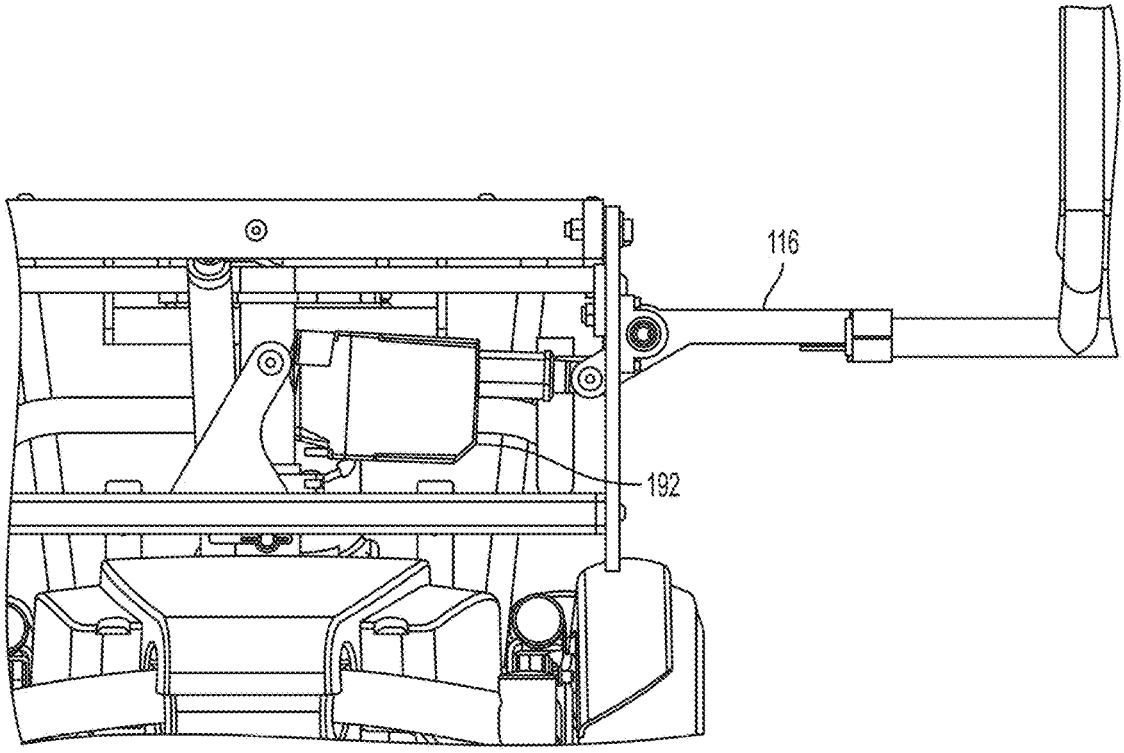
FIG. 1H is a close-up view of a backrest actuator of a rollable chair, according to an illustrative embodiment of the invention.

Referring now to FIG. 1D, in some embodiments, the bed 108 includes two sensors 173A, 173B, connected by a bar 175, collectively forming a "bumper" (e.g., the second frame 136) connected to the bed 108 for determining a position of the rollable chair 104 with respect to the bed 108. The sensors 173A, 173B can be in electronic communication with the microprocessor 164. The sensors 173A, 173B can detect a physical indication that the bed 108 has come into proper alignment with the rollable chair 104 (e.g., is at the right orientation or distance). The sensors 173A, 173B can relay a sensed signal to the microprocessor 164, which can cause the computing device 164 to cut power to the drive wheels 122B, 122E of the rollable chair 104. In some embodiments, the sensors 173A, 173B are attached to a bar 175 (e.g., the second bed frame 136 shown and described above) to form a dock that is bolted to the bed 108. When the rollable chair 104 is backed into the dock (e.g., as shown below but not depicted here separately), in the correct orientation, the rollable chair 104 can collapse both bump sensors 173A, 173B, closing an electronic switch that is normally open, indicating to the computing device 164 that the rollable chair 104 is in the correct position for transfer. The geometry can be such that no other position of the chair will allow both sensors to activate.

Figure 2A:
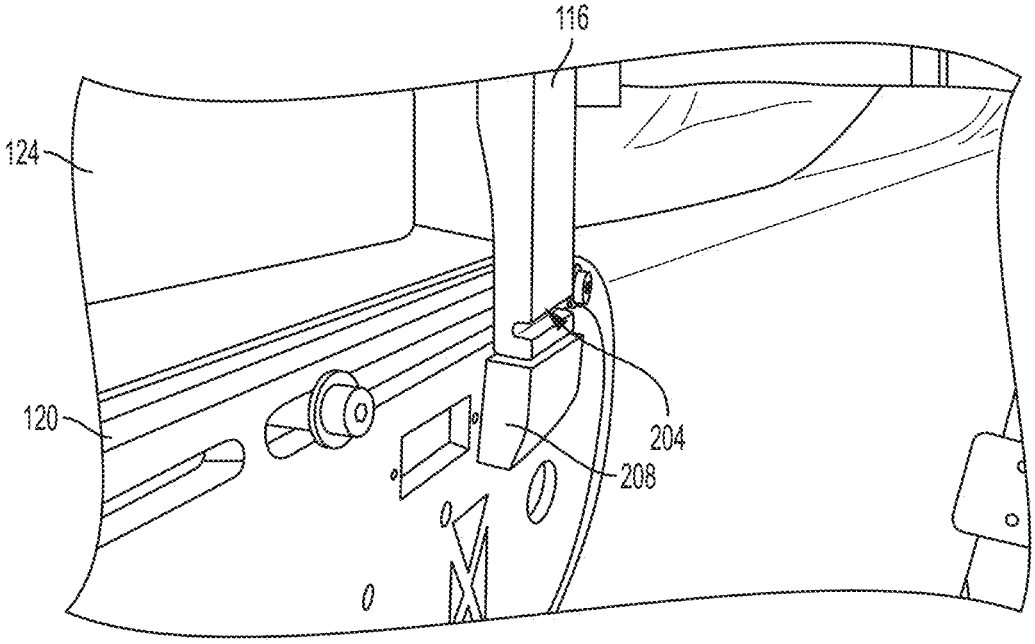
FIG. 2A is a perspective view of a latching mechanism of a rollable chair, in the unlatched position, for capturing a backrest, according to an illustrative embodiment of the invention.
Figure 2B:
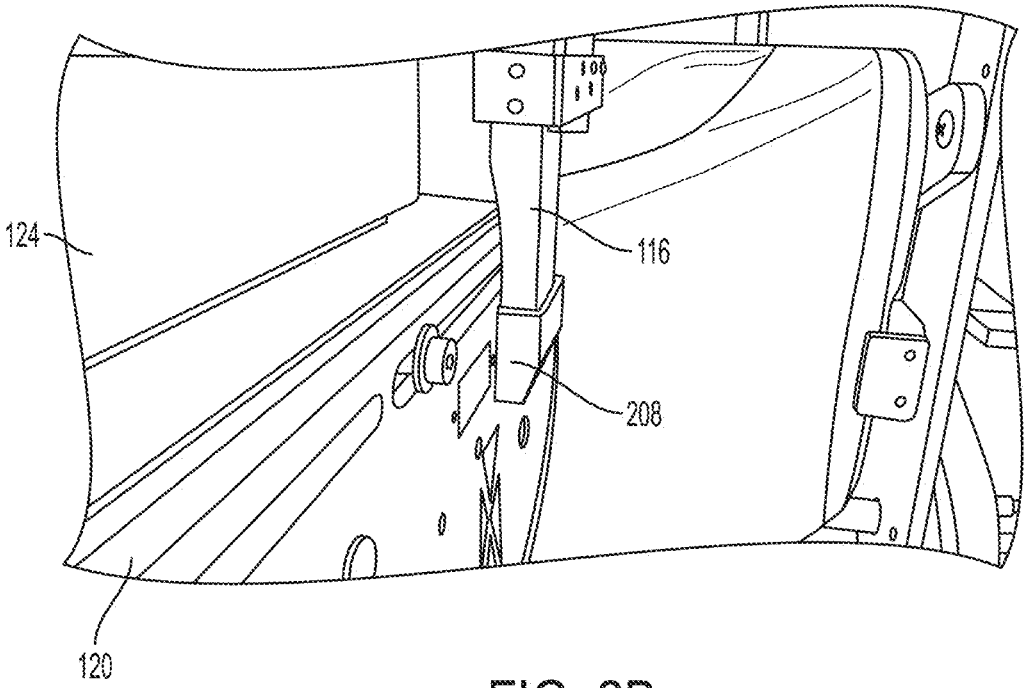
FIG. 2B is a perspective view of a latching mechanism of a rollable chair, in the latched position, for capturing a backrest, according to an illustrative embodiment of the invention.

FIG. 2A is a perspective view of a latching mechanism 204 of a rollable chair, in the unlatched position, for capturing a backrest, according to an illustrative embodiment of the invention. In some embodiments, the second frame 116 of the rollable chair 104 shown and described in FIG. 1 includes the latching mechanism 204, and the third frame 120 of the rollable chair 104 includes a corresponding latching mechanism 208. The corresponding latching mechanism 208 on the third frame 120 includes a taper. As the second frame 116 is pushed into the corresponding latching mechanism 208, the tapered surface on the corresponding latching mechanism 208 pushes 116 tightly against the third frame 120, which secures it to be used as a backrest without excessive "wobbling" or "play". In this embodiment, there is no "positive latching", which eliminates the need for an additional actuator to "latch" or positively constrain the backrest. The latching mechanism 204 can be a bore in the second frame 116, i.e., resembling a half-cylindrical shape. The corresponding latching mechanism 208 can be made of plastic or another suitable material. FIG. 2B is a perspective view of a latching mechanism of a rollable chair, in the latched position, for capturing a backrest, according to an illustrative embodiment of the invention. Fully engaged, the latching mechanism 204 is no longer visible, but is tightly and flushly secured within the corresponding latching mechanism 208.

Figure 3A:
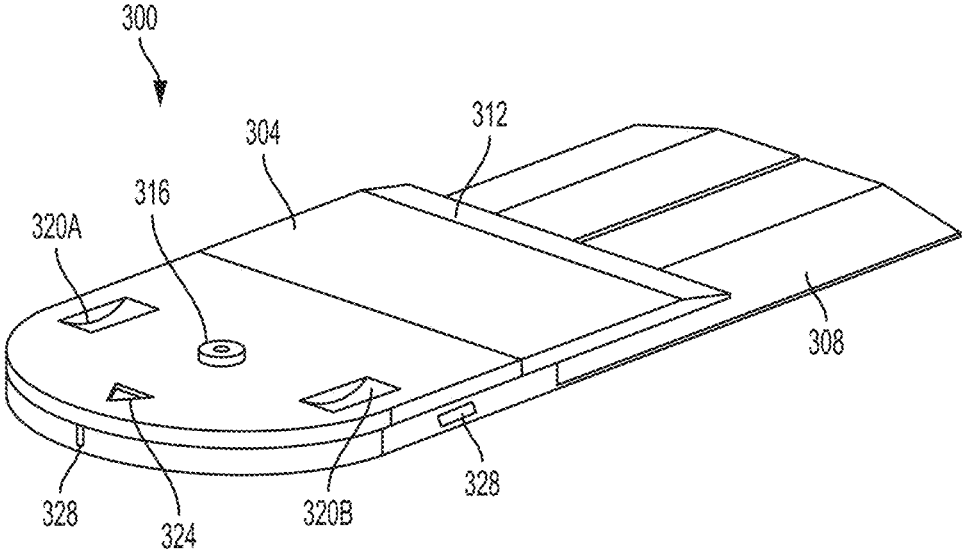
FIG. 3A is a perspective view of a docking assembly for a patient transfer system in which the docking assembly is in a closed position, according to an illustrative embodiment of the invention.

FIG. 3A is a perspective view of a docking assembly 300 for a patient transfer system in which the docking assembly 300 is in a closed position, according to an illustrative embodiment of the invention. The docking assembly 300 has a platform 304 and a base 308. The platform 304 is configured to receive a rollable chair (e.g., the rollable chair 104 shown and described in FIG. 1A) and to facilitate transfer of a patient from the rollable chair to a bed (e.g., the bed 108 shown and described in FIG. 1A). The platform 304 and/or the base 308 can be made of, for example, aluminum, steel, or a composite material. The platform 304 can include a ramp feature 312 for allowing the rollable chair to roll onto the assembly with ease. The platform 304 can include a pivot feature 316 to allow the platform 304 to rotate with respect to the base 308. The platform 304 can include depressions 320A, 320B for receiving specific wheels of the rollable chair (e.g., drive wheels 122C, 122D of the rollable chair shown and described in FIG. 1). The platform 304 can include a rotation marker 324 for aligning to a corresponding rotation marker 328 of the base 308 to signify when the rollable chair is in the proper position for a patient transfer operation.

In some embodiments, the docking assembly 300 has two degrees of freedom (e.g., a first degree including a linear dimension of fore and aft translation, and a second degree including rotation about the pivot feature 316). In some embodiments, the entire docking assembly 300 can roll or slide toward the bed 108 (or a top component of the docking assembly can roll or slide over the base). In some embodiments, the platform 304 can rotate 360 degrees and be accessible to the chair from any approaching direction. In some embodiments, the docking assembly 300 is short enough in height to be able to fit under the bed when it is not in use, e.g., about 50 millimeters.

Figure 3B:
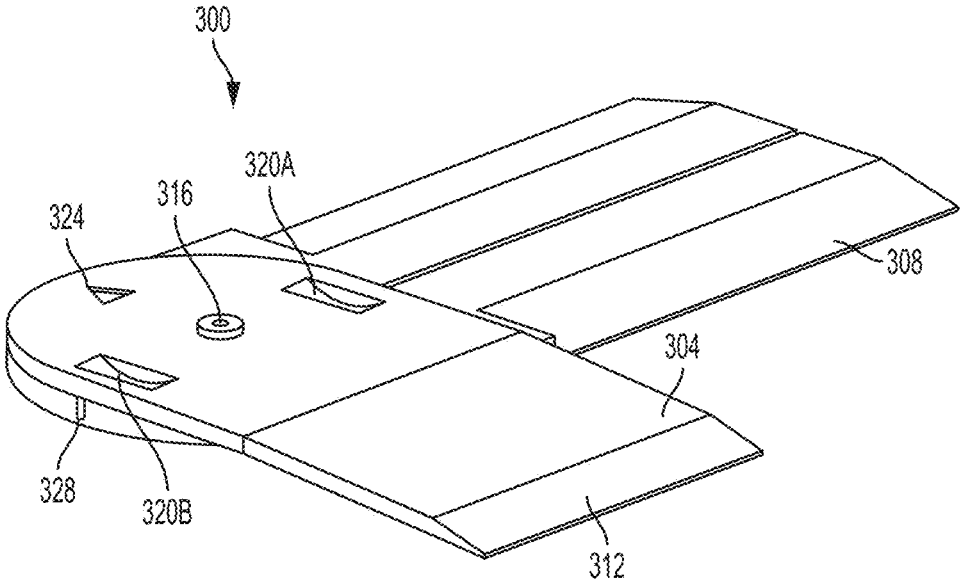
FIG. 3B is a perspective view of a docking assembly for a patient transfer system in which the docking assembly is in an open position, according to an illustrative embodiment of the invention.

In some embodiments, the docking assembly 300 is configured to receive the rollable chair from any angle of approach within a ground plane. For example, FIG. 3B shows the docking assembly 300 in an "open" position in which the platform is rotated 90 degrees from the closed position (shown in FIG. 3A) with respect to the base. In some embodiments, the docking assembly 300 includes a third microprocessor 328 in direct or indirect electronic communication with the computing device and/or the first and second microprocessors (e.g., as shown above). In some embodiments, the third microprocessor 328 causes one or more actuators connected to the docking assembly 300 to effect the translational and the rotational movements required or desirable for a patient transfer operation. In some embodiments, the docking assembly 300 includes four panels to allow it to break down more easily, e.g., to allow it to be assembled inside a room that has tight doorways and/or passageways.

FIGS. 4A-4H is are depictions of a patient transfer mechanism 400 having a rollable chair 404, a bed 408, and a docking assembly 412 in various stages of operation during a patient transfer operation, according to an illustrative embodiment of the invention. The rollable chair 404 has a first frame 416 including a seat 420. The rollable chair 404 also has a second frame 424 coupled to the first frame 416. The second frame 424 includes a chair back 428 configured to move relative to the first frame 416. The rollable chair 404 also includes a third frame 432 coupled to the first frame 416. The third frame 432 includes a track having a curvilinear length 432A configured to allow the first frame 416 to rotate and to translate relative to the third frame 432. A patient 436 occupies the rollable chair 404 at the start of an exemplary patient transfer operation.

Figure 4A:
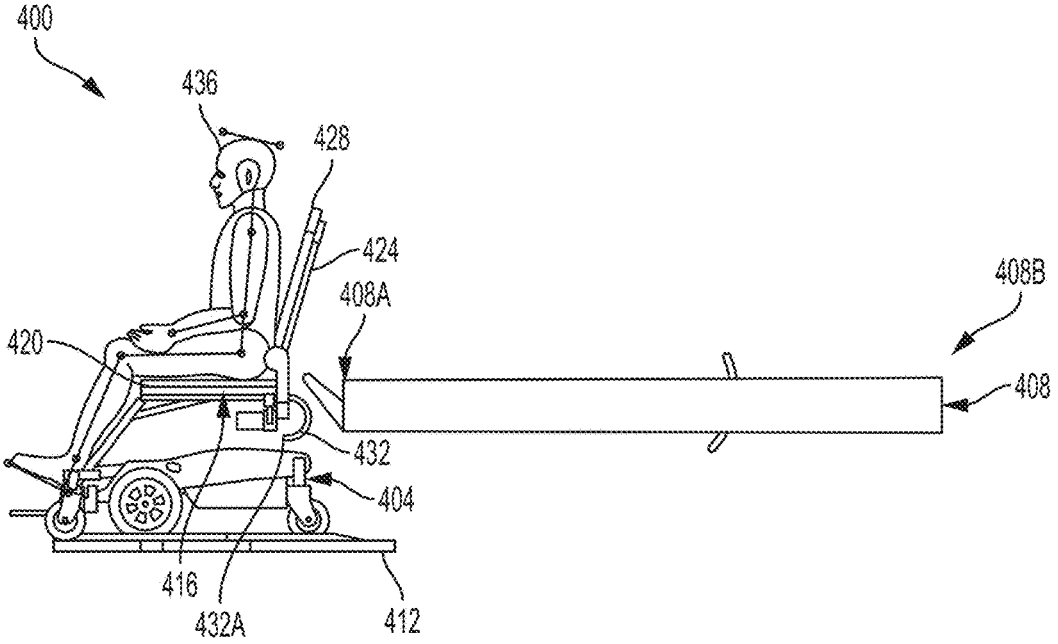
FIGS. 4A-4H is are depictions of a patient transfer mechanism having a rollable chair, a bed, and a docking assembly in various stages of operation during a patient transfer operation, according to an illustrative embodiment of the invention.
Figure 4B:
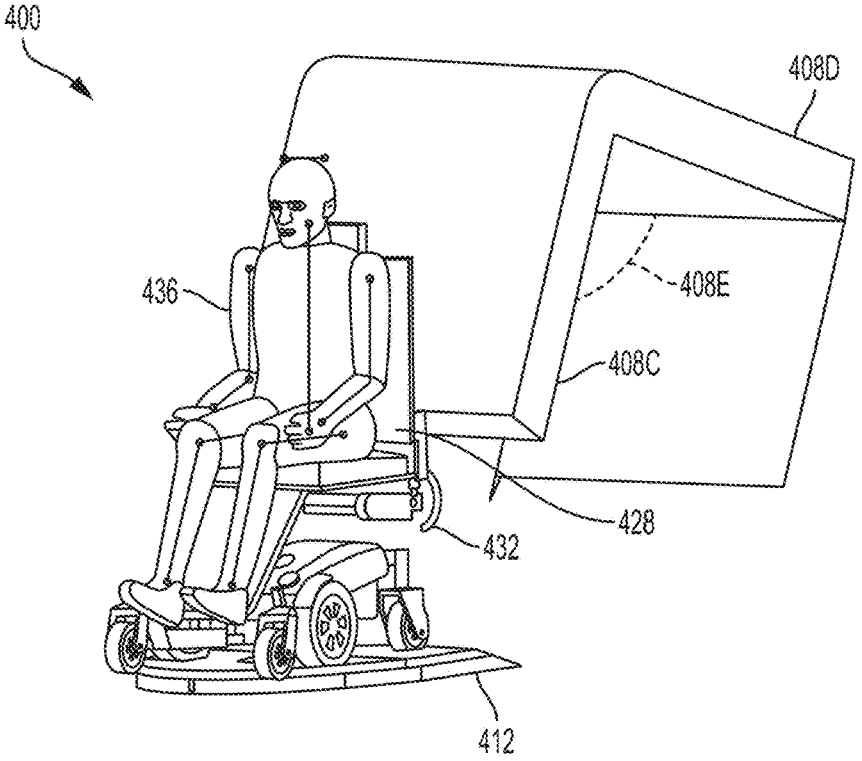

Referring to FIG. 4A, the rollable chair 404 is first positioned at or near a proximal end (e.g., a foot end) 408A of the bed 408 (the proximal end 408A opposite a distal end 408B). For example, a caregiver or the patient 436 can back the rollable chair 404 to the foot end 408A of the bed 408, e.g., sufficiently close so that the bed 408 can eventually support a backside of the patient 436. The distal end 408B of the bed 408 is then translated toward the proximal end 408A of the bed 408, the bed thereby folding into a first section 408C and a second section 408D, as shown in FIG. 4B. The first section 408C becomes positioned behind a chair back or chair back 428 of the rollable chair 404, and the second section 408D forms an angle 408E with the first section 408C.

Figure 4C:
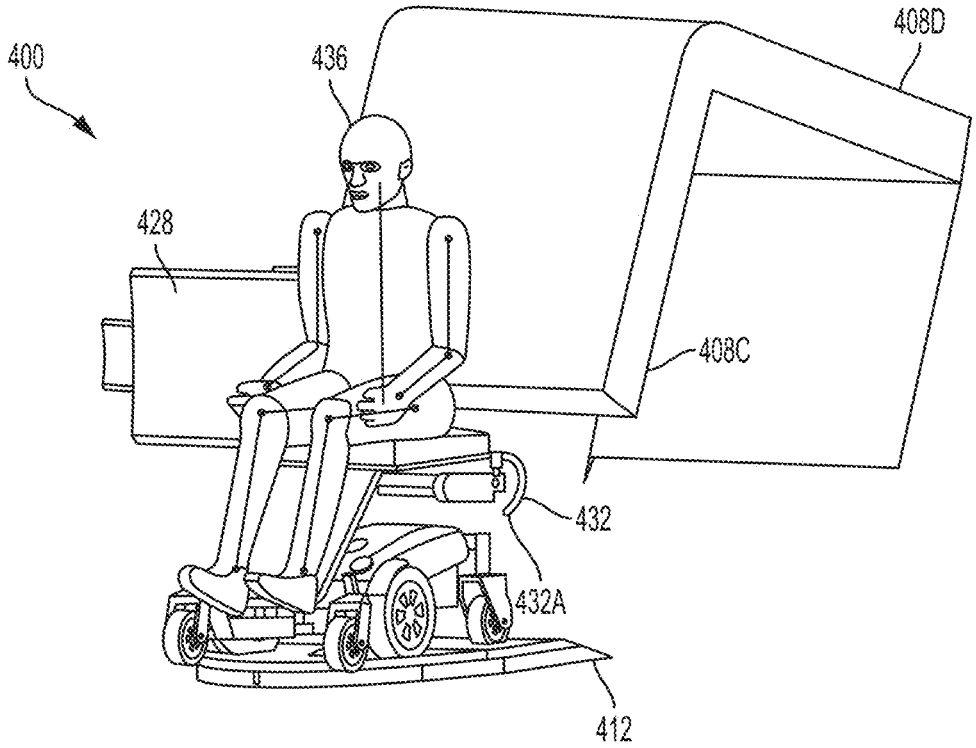

Referring to FIG. 4C, the chair back 428 of the rollable chair 404 is then moved, via at least one of a rotational or a translational motion (a rotational motion about a pivot point on the right of the chair, from the perspective of the patient 436, as shown in FIG. 4C), such that the patient 436 contacts (or now may contact) the first section 408C of the bed 408. In some embodiments, an operator is further prompted to confirm electronically that the chair back 428 should in fact swing away, clearing the path from the patient 436 to the first section 408C of the bed 408.

Figure 4D:
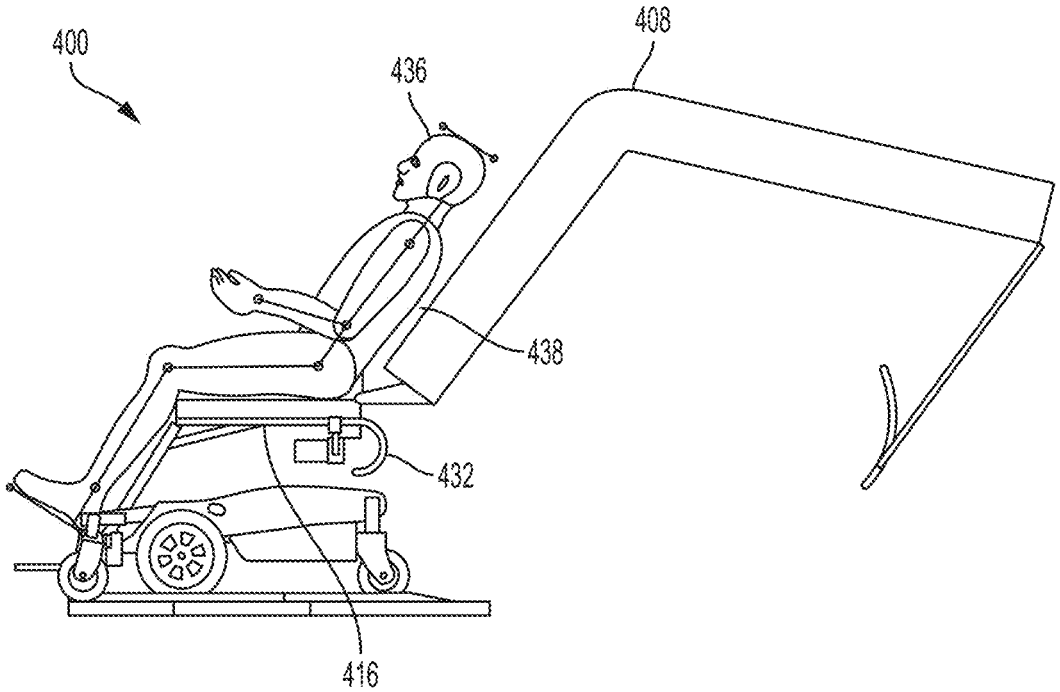
Figure 4E:
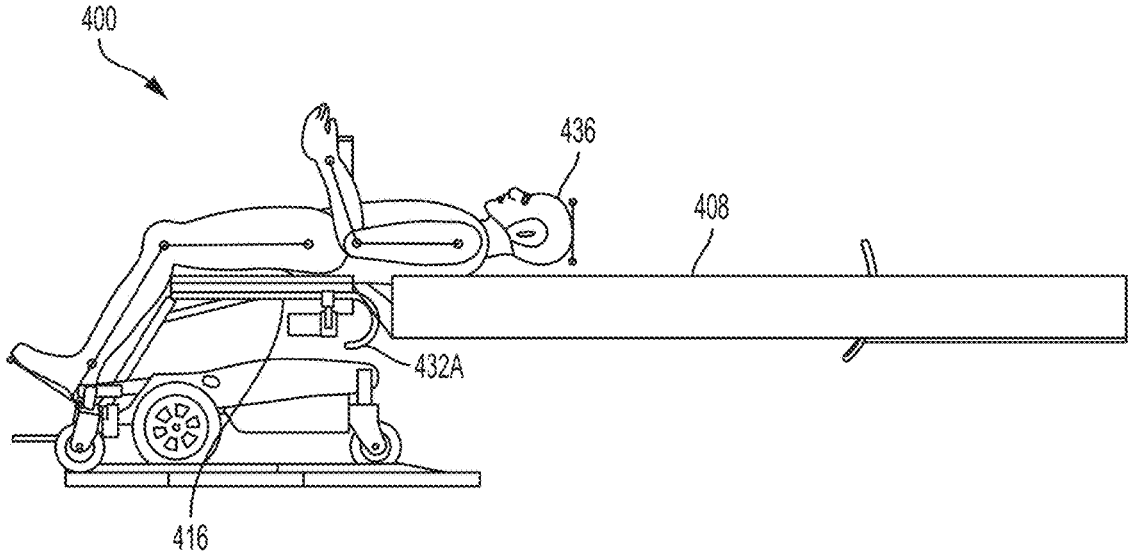
Figure 4F:
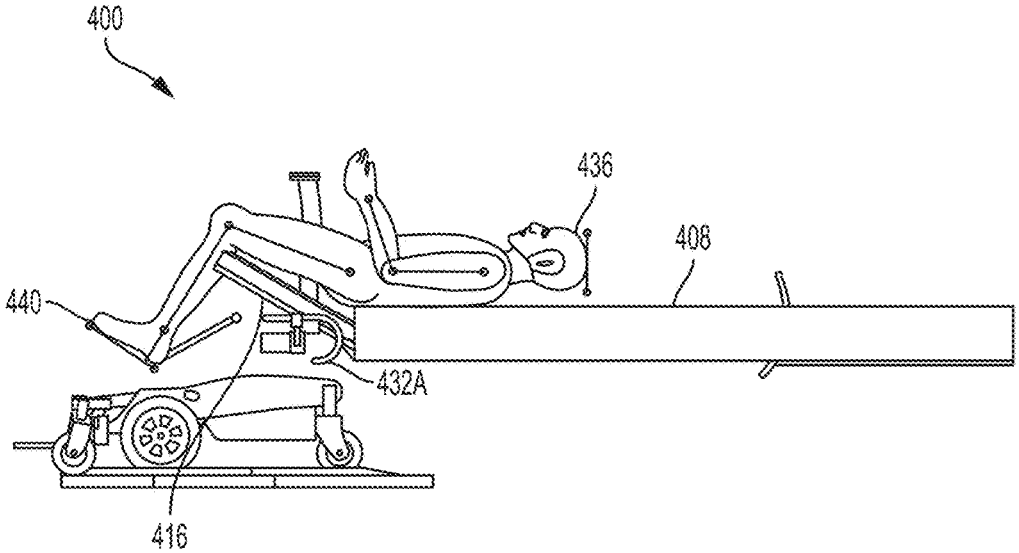

With a back of the patient 436 now leaning against the first section 408C of the bed 408, referring now to FIG. 4D, a seat frame or first frame 416 of the rollable chair 404 is moved along a guide rail or third frame 432 disposed relative to the seat frame 416 (e.g., in mechanical communication with or interlocking with), via at least one of a translational or a rotational motion, to position the patient 436 at least substantially on the bed 408, e.g., as shown in FIG. 4E. As shown, the first section 408C of the bed 408 begins to recline and convey the patient 436 onto the bed. Referring to FIG. 4F, the first frame 416 follows the curvilinear portion 432A of the guide rail/third frame 432, such that the first frame 416 is translated and rotated with respect to the third frame 432. A fourth frame/leg rest 440, rigidly coupled to the first frame 416, aids in transporting the legs of the patient 436 closer to the bed 408.

Figure 4G:
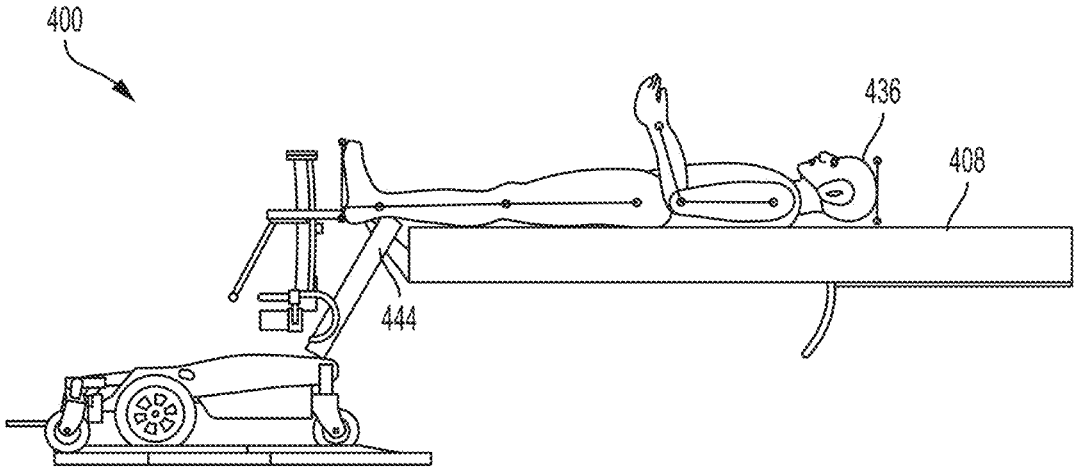
Figure 4H:
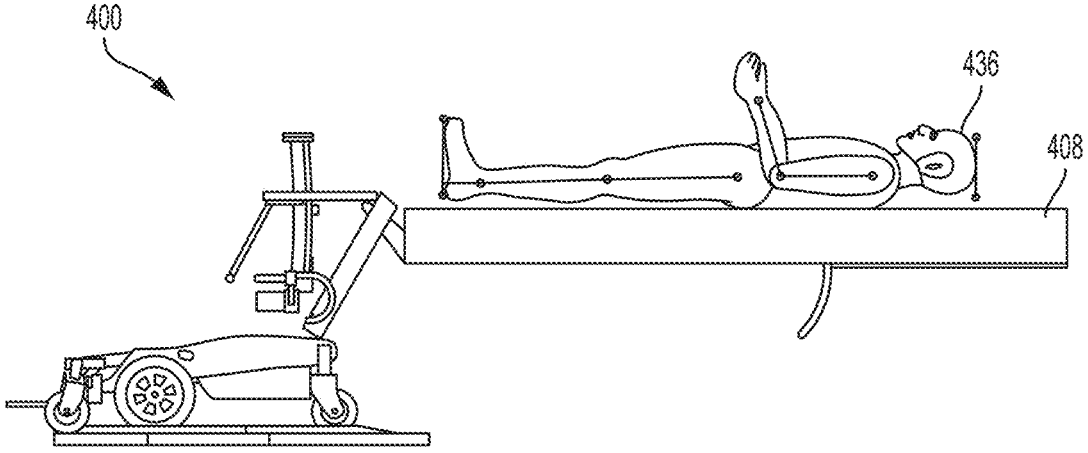

Meanwhile, referring to FIG. 4G, the first frame 416 continues moving along the first frame 416 while a roller mechanism (e.g., two powered spools with a "transfer sheet" or "conveyor sheet", not depicted for neatness) moves the patient 436 toward the distal end 408B of the bed 408. In some embodiments, the transfer sheet that moves the patient to and from the bed is moved up and over a surface of the bed mattress by two powered spools at the head end and foot end of the bed 408. In this embodiment, the fourth frame 440 can pivot along a pivot point 444 to remain out of the way of the patient 436 transferring to the bed 408. The roller mechanism can continue to move the patient 436 further toward the distal end 408B of the bed 408, positioning the patient 436 in a final resting position on the bed as shown in FIG. 4H. In some embodiments, the transfer to bed is completed when a through-beam emitter sensor and receiver sensor located at the foot end of the bed senses the patient's feet passing. The motions shown in FIGS. 4A-4H can be reversed, e.g., exactly or substantially, to effect a transfer in the opposite direction from the bed 408 to the rollable chair 404.

In some embodiments, the patient transfer system 400 includes a user interface on a computing device that provides a series of verbal prompts during the course of operation. For example, the computing device can verbally prompt the operator (e.g., the patient or the caregiver) to remove sheets and blankets from the bed before beginning the transfer process. In some embodiments, after transferring the patient 436 to the bed, the bed automatically resets itself into a position to start the "to chair" transfer. In some embodiments, when ready to transfer back to the rollable chair 408, the conveyor sheet moves the patient 436 toward the foot end of the bed 408. As the patient's feet (or lower extremity) pass through the through-beam sensor at the foot end of the bed 408, software on the computing device can command the actuator controlling the first frame (e.g., seat rotation frame) to begin rotating as defined in the software parameters.

Once the seat is fully rotated, the head deck portion and foot deck portion of the bed frame are commanded by software on the computing device to rotate so that a foot deck portion of the mattress is moved to assist in moving the patient 436 into a seated position within the rollable chair 408. After the foot deck portion of the mattress has moved the person into the maximum seated position, the operator is prompted to activate the powered backrest into the locked upright position. After the backrest is locked in place, the seat translates and/or rotates away from the bed to further position the patient into a fully seated position. After the seat frame has translated forward to its maximum forward position, the operator is prompted to activate the rollable chair drive system, and the patient can drive the rollable chair 408.

In some embodiments, the timing and angle of chair movement is adjustable to accommodate height, weight and other attributes of individual patients. In some embodiments, the timing of the custom seat and bed functions are coordinated via software commands. In some embodiments, a transfer to or from a bed takes approximately two minutes. In some embodiments, there is an emergency pull switch that flattens the bed and cuts the power. In some embodiments, there is a battery backup that allows for five complete transfer cycles in two days.

In some embodiments, the conveyor sheet can be a 70 Denier Nylon, PVC coated material per IEC 60601 fire safety guidelines. In some embodiments, the conveyor sheet and can be 94"L×34"W×0.024" H. In some embodiments, the conveyor sheet is very thin, e.g., if used with a pressure-relieving mattress, so as not to interfere with the goals of a such a mattress. In some embodiments, a fabric, 96"×35", 60/40 poly/cotton bed sheet, is attached to the conveyer sheet with Velcro™ tabs and is used as the sleeping surface. The presence of the sheet does not need to interfere with the transfer into and out of the bed. The bed sheet can also be removed for regular washing as necessary. In some embodiments, the conveyor sheet remains in place and can be spot cleaned using disinfectant wipes. Periodic removal for more extensive cleaning and servicing is recommended and scheduled with the customer. Unless there is tearing or damage caused by misuse, the conveyor sheet can be replaced with a new or reconditioned sheet at the time of servicing. Changing the conveyor sheet can be a simple process, which takes approximately 15 minutes.

In some embodiments, when the patient transfer system 400 is active (input to the UI and/or system motion), every 100 ms a main controller (e.g., the computing device 164 shown and described above) communicates to a data logger the state of all electrical components (discrete input devices, motor currents/voltages, power supply input/output and batteries). In some embodiments, the data logger records these data to the USB memory device. For example, every 24 hours the data logger can write the day's data to a compressed file archive. In such embodiments, a 8 GB USB memory device can handle one day of continuous system operation and the archived data from the previous 30 days. In some embodiments, electronic components are located under the center of the bed.

In some embodiments, the invention incorporates an array of sensors to stop the operation of the patient transfer system if unsafe behavior is detected (e.g., clothing or parts of the body near moving parts, attempting to move the "patient" to far up the bed where they may hit the headboard). In some embodiments, the software prohibits moving from one step to the next without the sensors indicating that each step is completed. In some embodiments, the microprocessors are hardwired or wireless. In some embodiments, the microprocessors are in direct communication with one another or indirect communication, e.g., via a central processing hub.

In some embodiments, the bed interfaces with a Group 2 EPW equipped with a custom seating system. In some embodiments, the invention accommodates a wide variety of mattresses commonly used with hospital beds for acute care, long-term care, and homecare. In some embodiments, the bed incorporates one or more features of current "high-end" hospital beds, e.g., the ability to integrate several therapeutic pressure redistribution mattresses. In some embodiments, the custom wheelchair seating systems is compatible with a wide variety of seat cushions, such as foam, gel, air-flotation.

In some embodiments, the "J" track permits one continuous motion of the first frame along the third frame to provide seamless transfer of a patient from a rollable chair to a bed and back. In some embodiments, the track is mechanical or virtual (e.g., a set of actuators can be used to program the kinematics of motion that mimic a mechanical track). In some embodiments, a gap space 438 between patient and bed is minimized (e.g., minimized to a smallest practical length in view of competing constraints) at one or more points in the transfer, e.g., at the point shown in FIG. 4D, or at any given point in the transfer.

Figure 5:
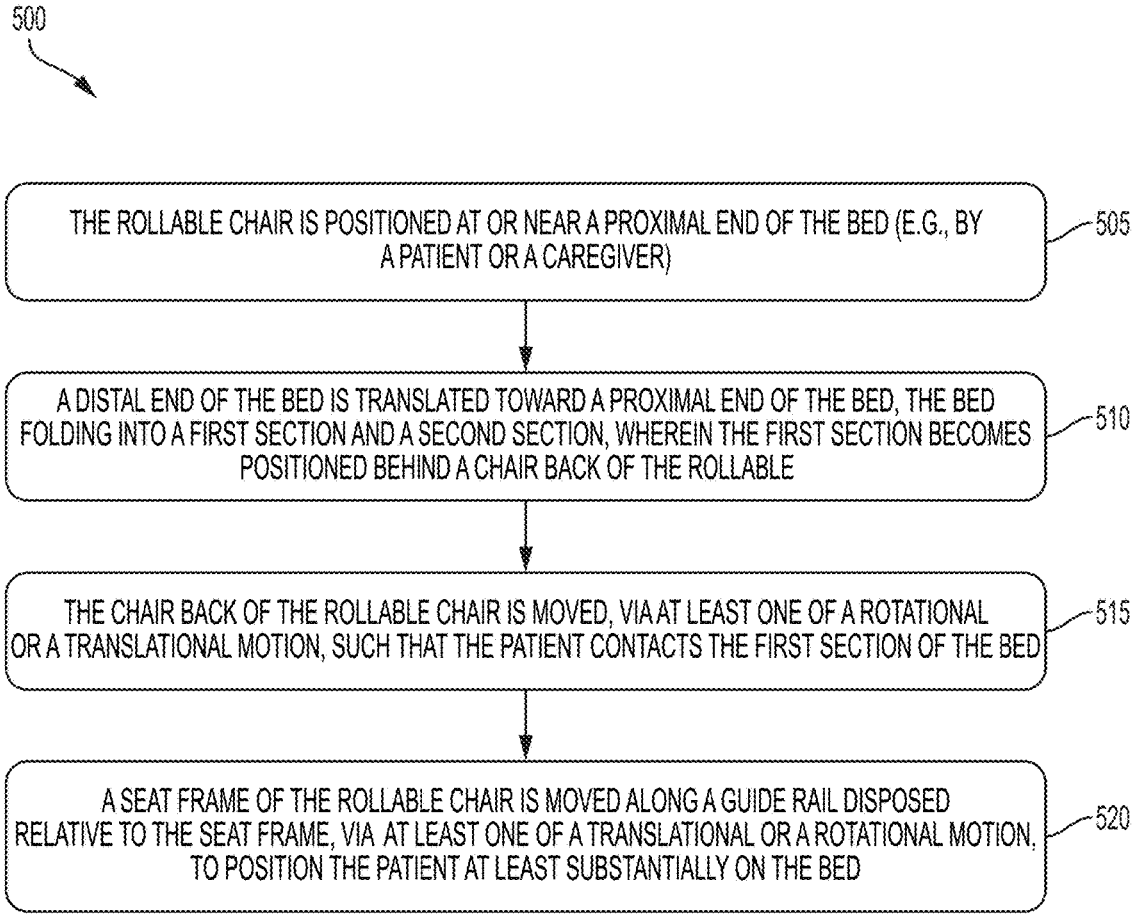
FIG. 5 is a flowchart of a method of transferring a patient from a rollable chair to a bed, according to an illustrative embodiment of the invention.

FIG. 5 is a flowchart of a method 500 of transferring a patient from a rollable chair to a bed, according to an illustrative embodiment of the invention. In a first step 505, the rollable chair is positioned at or near a proximal end of the bed (e.g., by a patient or a caregiver). In a second step 510, a distal end of the bed is translated toward a proximal end of the bed, the bed folding into a first section and a second section, wherein the first section becomes positioned behind a chair back of the rollable chair and the second section forms an angle with the first section. In a third step 515, the chair back of the rollable chair is moved, via at least one of a rotational or a translational motion, such that the patient contacts the first section of the bed. In a fourth step 520, a seat frame of the rollable chair is moved along a guide rail disposed relative to the seat frame, via at least one of a translational or a rotational motion, to position the patient at least substantially on the bed. In some embodiments, the guide rail is a track having a curvilinear length. In some embodiments, moving the chair back is accomplished using a powered actuator. In some embodiments, moving the seat frame is coordinated with a simultaneous or near-simultaneous moving of the bed. In some embodiments, moving the seat frame is coordinated with a simultaneous or near-simultaneous moving of a leg rest coupled to the seatframe. In some embodiments, positioning the rollable chair at or near a proximal end of the bed is achieved using a docking assembly positioned proximate the bed and the rollable chair.

Figure 6:
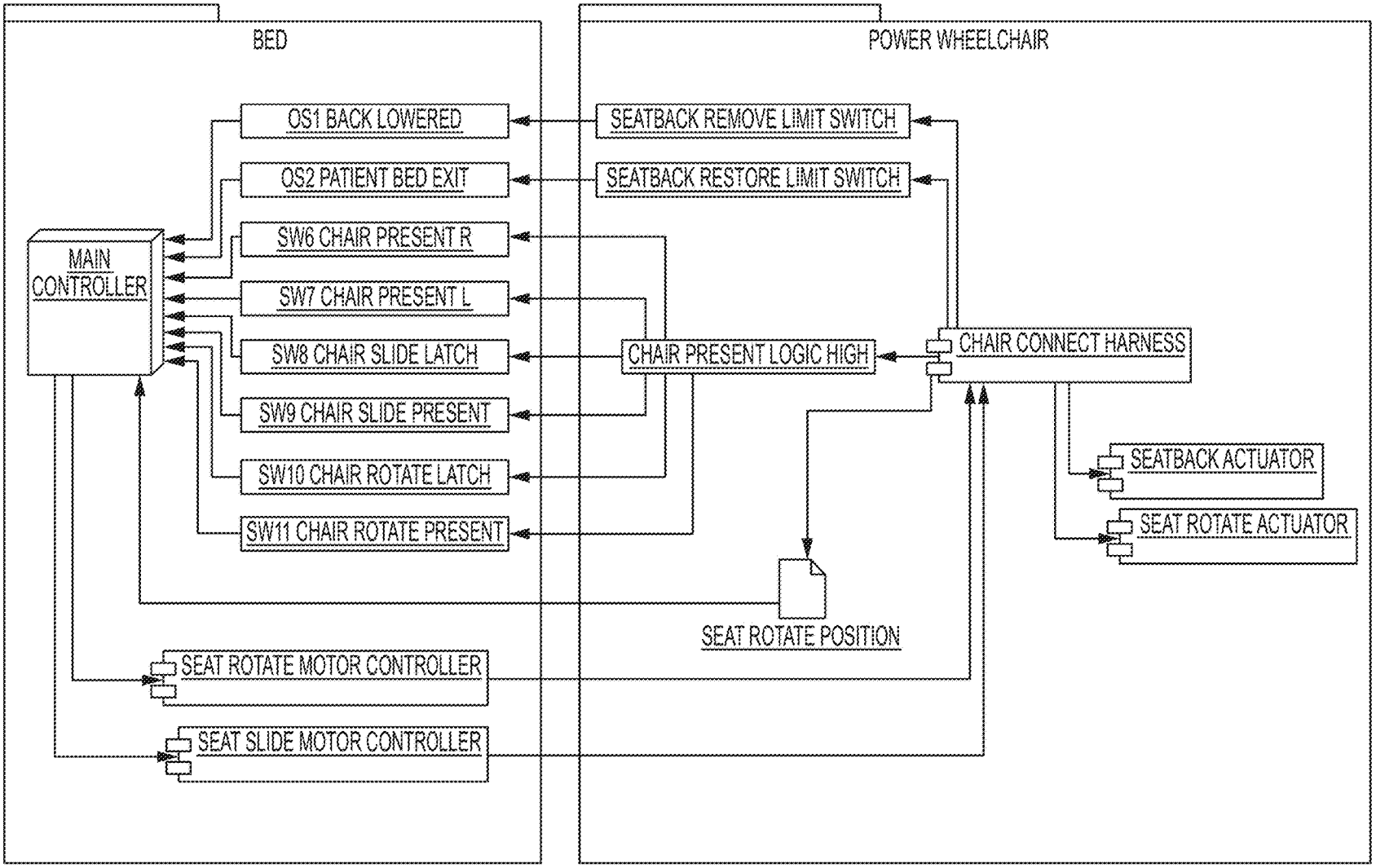
FIG. 6 is a schematic diagram of an electronic architecture for a patient transfer system, according to an illustrative embodiment of the invention.

FIG. 6 is a schematic diagram of an electronic architecture for a patient transfer system, according to an illustrative embodiment of the invention. In one exemplary sequence of events, a rollable chair as described above is driven against one or more switches in contact with the bumper. By this action, the rollable chair can activate one or more physical switches, e.g., "SW6 Chair Present R" and "SW7 Chair Present L". When the "Main Controller" (e.g., the computing device 164 shown and described above) detects that "SW6 Chair Present R" and "SW7 Chair Present L" are activated, it communicates to the "Seat Slide Motor Controller" to activate the "Seatback Actuator" through the "Chair Connect Harness" cable, which initiates movement of backrest (e.g., the backrest 116 shown and described above) to its transfer position. Once the backrest 116 strikes the switch "Seatback Remove Limit Switch," a signal is sent through port "OS1 Back Lowered" and to the "Main Controller."

The "Main Controller" then sends a signal to the "Seat Slide Motor Controller" to stop the "Seatback Actuator", hence stopping the motion of the backrest. Completion of backrest removal initiates rotation of the seat (e.g., the seat 112 shown and described above) by the "Main Controller". The "Main Controller" then sends a signal to the "Seat Rotate Motor Controller" telling it to turn on the "Seat Rotate Actuator", which rotates the seat toward the bed. As the Seat rotates, the potentiometer sensor "Seat Rotate Position" sends signals to the "Main Controller" that state its current position. This information is used to coordinate the movements of the bed. When the seat physically contacts "SW11 Chair Rotate Present," a signal is sent to the "Main Controller" indicating that seat has rotated to its maximum extent. The "Main Controller" sends a signal to the "Seat Rotate Motor Controller," telling it to stop the motion of the "Seat Rotate Actuator", which stops the rotation of the seat. The bed continues its own to position the person using the sheet and spool (not depicted), as in the manual chair product.

To return the patient to the rollable chair, the above steps can be executed substantially in reverse, with some exceptions. First, for the backrest striking the switch "Seatback Remove Limit Switch," the "Seatback Restore Limit Switch" is physically contacted and port "OS2 Patient Bed Exit", indicating the backrest is in its driving configuration. Second, for the seat physically contacting "SW11 Chair Rotate Present", the motion of the seat rotation physically contacts the "SW10 Chair Rotate Latch" indicating the seat (112) is it drive position. The "Chair Connect Harness" is the physical connector that when connected tethers the bed wires to the wheelchair. "SW8 Chair Slide Latch" and "SW9 Chair Slide Latch" are legacy switches that are still physically present of the bed from the manual chair version but are not used in the power chair version.

While the invention has been particularly shown and described with reference to specific preferred embodiments, it should be understood by those skilled in the art that various changes in form and detail may be made therein without departing from the spirit and scope of the invention as defined by the following claims.

What is claimed is:

1. A rollable chair comprising:

a first frame including a seat;

a second frame coupled to the first frame, the second frame including a backrest configured to move relative to the first frame; and a third frame coupled to the first frame, the third frame including a track comprising a linear length fixed parallel with respect to a ground surface plane and an adjoining arc length subtending a central angle of between 120 and 180 degrees, the third frame configured to allow the first frame to rotate and to translate relative to the third frame.

2. The rollable chair of claim 1 wherein the track further includes a linear length configured to allow the first frame to translate relative to the third frame, the linear length adjoining the curvilinear length.

3. The rollable chair of claim 1 wherein the first frame is powered by a first actuator that is mechanically coupled to the first frame.

4. The rollable chair of claim 1 further including at least one sensor, connected to the rollable chair, for determining a position of the rollable chair relative to a bed.

5. The rollable chair of claim 1 wherein the second frame is configured to rotate about a pivot point to permit the backrest to be removed from a path of patient transfer between the rollable chair and a bed.

6. The rollable chair of claim 1 wherein the second frame is powered by a second actuator that is mechanically coupled to the second frame.

7. The rollable chair of claim 1 wherein the second frame includes a latching mechanism configured to engage with a corresponding latching mechanism of the third frame.

8. The rollable chair of claim 7 wherein the corresponding latching mechanism on the third frame includes a taper configured to proper alignment of the rollable chair.

9. The rollable chair of claim 7 further including a quick-release feature for aiding an assistant with disengaging the rollable chair from a bed.

10. The rollable chair of claim 1 wherein the rollable chair further includes a fourth frame that is mechanically coupled to the first frame, the fourth frame including a leg rest.

11. The rollable chair of claim 10 wherein the first and fourth frames are rigidly coupled, the fourth frame configured to guide a patient's legs during a patient transfer operation.

12. The rollable chair of claim 1 wherein the rollable chair is configured to couple to a bed having a chair receiving frame.

13. The rollable chair of claim 1 wherein the seat has a posterior tilt with respect to the rollable chair.

14. A patient transfer system comprising:

a rollable chair including:

a first frame including a seat;

a second frame coupled to the first frame, the second frame including a backrest configured to move relative to the first frame; and a third frame coupled to the first frame, the third frame including a track comprising a linear length fixed parallel with respect to a ground surface plane and an adjoining arc length subtending a central angle of between 120 and 180 degrees, the third frame configured to allow the first frame to rotate and to translate relative to the third frame; and a bed including a chair receiving frame configured to couple to the first frame of the rollable chair.

15. The patient transfer system of claim 14 further including a first microprocessor coupled to the rollable chair and a second microprocessor coupled to the bed, the first microprocessor in direct or indirect electronic communication with the second microprocessor.

16. The patient transfer system of claim 14 further including a computing device in electronic communication with the first and second microprocessors, the computing device configured to execute instructions to coordinate kinematics between the rollable chair and the bed during a patient transfer operation.

17. The patient transfer system of claim 16 wherein a motion path of the seat is determined by the computing device and includes both translational and rotational components.

18. The patient transfer system of claim 14 wherein the bed is configured to fold during a patient transfer operation between the rollable chair and the bed, the bed configured to work in tandem with the rollable chair to receive the patient during a patient transfer operation.

19. The patient transfer system of claim 14 further including a docking assembly configured to receive the rollable chair and to facilitate transfer of a patient from the rollable chair to the bed.

20. The patient transfer system of claim 19 wherein the docking assembly is configured to receive the rollable chair from any angle of approach within a ground plane.

21. The patient transfer system of claim 15 wherein the docking assembly includes a third microprocessor, the third microprocessor in direct or indirect electronic communication with the first and second microprocessors.

22. The patient transfer system of claim 14 wherein the bed includes a sensor configured to ensure that the rollable chair is properly positioned with respect to the bed.

23. The patient transfer system of claim 14 wherein the rollable chair is a retrofitted Group 2 Electric Powered Wheelchair.

* * * * *